US006305456B1

(12) United States Patent
Sanchez

(10) Patent No.: US 6,305,456 B1
(45) Date of Patent: Oct. 23, 2001

(54) OPERATING DEVICES AND SLATS FOR REVERSIBLE WINDOW BLINDS

(75) Inventor: Francisco Lujan Sanchez, Illescas (ES)

(73) Assignee: Ceraper S.L., Toledo (ES)

( * ) Notice: Subject to any disclaimer, the term of this patent is extended or adjusted under 35 U.S.C. 154(b) by 0 days.

(21) Appl. No.: 09/344,767

(22) Filed: Jun. 25, 1999

(30) Foreign Application Priority Data

Jun. 26, 1998 (ES) ..... 9801704 U
Jul. 6, 1998 (ES) ..... 9801785 U

(51) Int. Cl.[7] ..... E05F 15/00
(52) U.S. Cl. ..... 160/188; 160/36; 160/201
(58) Field of Search ..... 160/133, 310, 160/188, 32, 35, 26, 36, 235, 201

(56) References Cited

U.S. PATENT DOCUMENTS 1,697,646 * 1/1929 Halvorsen .
3,516,469 * 6/1970 McDonald .
4,343,340 * 8/1982 Paule .
4,795,206 * 1/1989 Adams .
4,889,381 * 12/1989 Tamblyn et al. .
4,966,219 * 10/1990 Sonolet .
5,322,108 * 6/1994 Hoffman .
5,343,922 * 9/1994 Rankl et al. .
5,722,476 * 3/1998 Lujan-sanchez et al. .
6,176,291 * 1/2001 Sanchez et al. .

* cited by examiner

*Primary Examiner*—Blair M. Johnson
(74) *Attorney, Agent, or Firm*—Ladas & Parry

(57) ABSTRACT

Improved operating devices for reversible blinds, in such a way that the movement of the latter is caused when the projections (8) of the slats (101) mesh into the two driving pinions (60) and (62), which move simultaneously thanks to two couples of transmission pinions (59) and (61) and intermediate wheels (63) and (64), reverting the hand operating device on the first transmission pinion (59) through a bevel wheel (58) moved by a bevel pinion (57), which is operated by means of a handle (52) through four separating pinions (56), while the motorized operating device reverts on the first transmission pinion (59) through a two stage reducing device of the planetary type and a motorization gear (78); having the slat hook (104) been modified to adapt to the inward cranked flange (107) which, in turn, occupies more than half of the width of the slat (101).

8 Claims, 12 Drawing Sheets

OPERATING DEVICES AND SLATS FOR REVERSIBLE WINDOW BLINDS

FIELD OF THE INVENTION

The subject matter of the present invention is a hand or motorized operating device specially adapted for reversible window blinds of the type whose slats are guided inside labyrinth tracks and have the particularity that they can alternatively show both sides of the blind in the same direction.

Along this same development line, the improvements introduced in the slats are mainly aimed at obtaining slats for reversible blinds which are specially silent and wear resistant.

Description of the Prior Art

A blind of this type is described in U.S. Pat. No. 5,722,476 of the same owner, being the blind in this case made up of elongated and hollow slats, which have connected, at both ends, two caps with wheels which slide along the inside of the corresponding side labyrinth configuration tracks, or several cylindrical projections substituting the wheels.

U.S. Ser. No. 08/871,619 of the same owner relates to a new design of the box where the blind subject matter of the preceding invention lodges, which has at the side headers two profiles which allow a sliding assembling of the side plates which the labyrinth track guides have. This type of reversible blind construction, with sliding assembling, does not allow the easy use of conventional operating devices since, in the first place, the same effort must be used in both directions, in the second place, the blind must be braked also in both directions, and in the third place the ends of the travel must detect the physical position of the blind, not being appropriate the ends of the travels incorporated to the motor.

SUMMARY OF THE INVENTION

The operating device subject matter of the present invention solves the mentioned problems and perfectly adapts to the special structure of reversible blinds with sliding assemblage allowing to transform a hand operated device into a motorized one in an easy, quick and economic way, even after the initial installation of the blind.

The operating device subject matter of the invention uses the side plates which the labyrinth track guides use as a base, in such a way that this plates, once the different elements which constitute the hand or motorized operating device are assembled onto the same, they can in turn be assembled in a sliding manner onto the box foreseen during the carrying out of the construction.

The hand operating device is made up of a handle with conventional directional change of 90° from which starts a rod transmission which transmits a rotating motion in both directions to the reducing device for hand operation. The latter is made up of a straight gear train with four parallel and coplanar axis gear, having the last one of them an integral bevel pinion which acts of the corresponding bevel wheel, connected itself to a coaxial transmission pinion and to a coaxial driving pinion. Between the first straight pinion and the transmission rod there is inserted a bi-directional brake in such a way that, being it possible to operate the blind in both directions by means of the handle, the weight of the blind cannot make the handle turn in either of the two directions.

The motorized operating device is made up of a conventional alternating current asynchronous motor, whose final pinion goes into a reducing device of the planetary type, with two cascade stages, whose outgoing pinion meshes into a gear coaxial to the axis which joins the two side plates, being itself integral to a transmission pinion.

Concerning the slats, an improvement consists in the side flange delimiting the intermediate slat channel being now straight instead of arched on its external side, which makes the aspect of the two sides of the blinds to be the same.

The inside of the mentioned side flange which delimits the intermediate slat channel maintains its curve concave shape to receive the hook of the adjoining intermediate slat which has been modified as to exactly adjust to the curvature of the cranked inwards flange which delimits together with side flange the intermediate slat channel in such a way that the hook and the inward cranked flange adjust their curvature when two adjoining slats form a 120° angle corresponding to the insertion of the blind in the side spiral tracks which constitute the labyrinth where the blind sits.

The third and last improvement introduced in the slats consists in the inward cranked flange, which facing the side flange mentioned before delimits the intermediate slat channel, has been increased in length, since now instead of ending at the middle plane of the slat, it occupies approximately 80% of its width, so that it drives the adjoining hook in an off-centered way, which causes less wear and noise because the slats are always leaning on the two sides of the tracks which receives them, thanks to the overturning couple to which they are subjected.

BRIEF DESCRIPTION OF THE DRAWINGS

In order to complement the description which will be carried out next and to help a better understanding of the characteristics of the invention, a detailed description will be carried out based on a set of drawings which is attached to this descriptive report, being an integrating part of the same, and where with a merely descriptive and not limiting purpose the following has been represented.

DESCRIPTION OF THE PREFERRED EMBODIMENT

Figure 1:
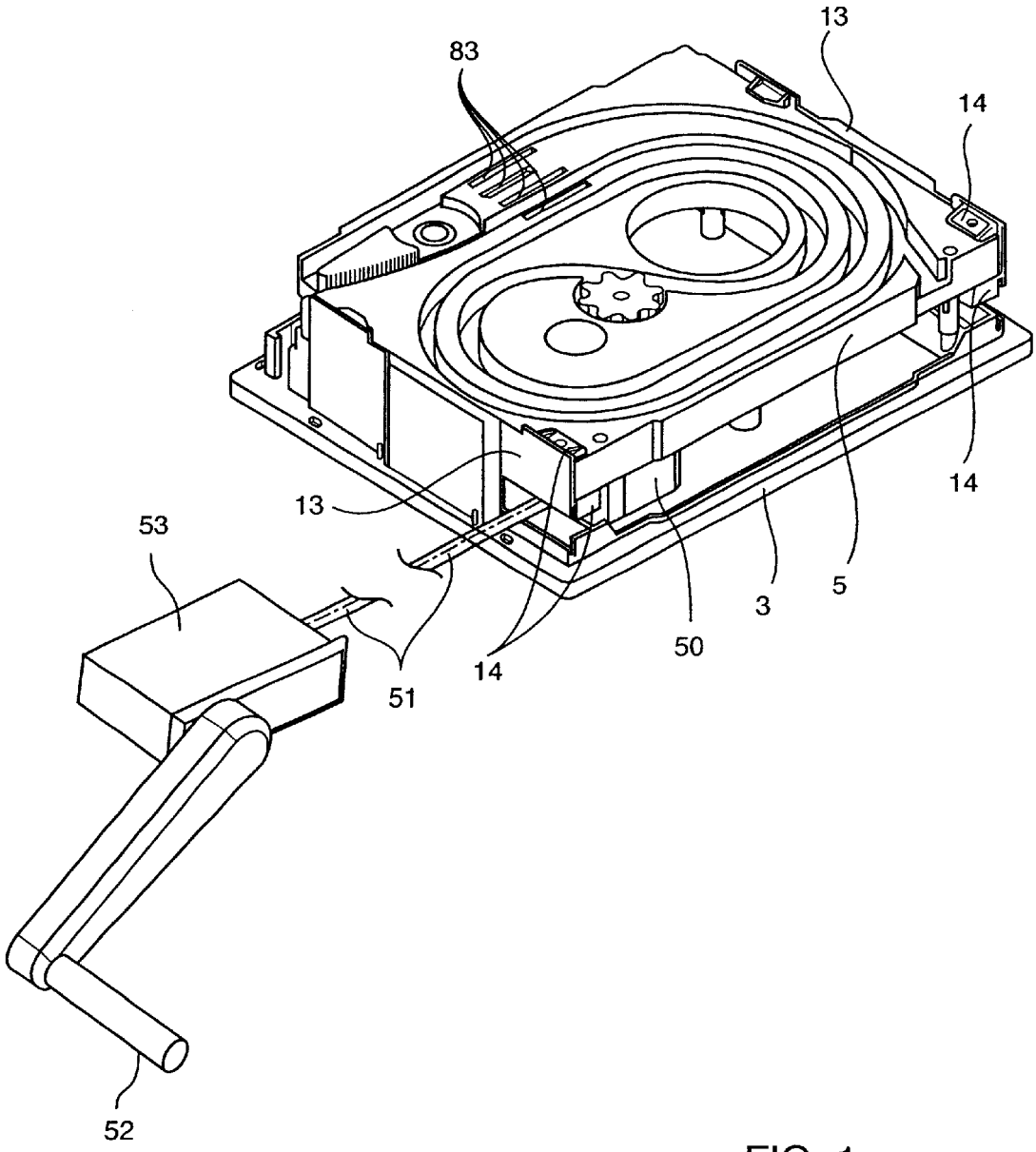
In FIG. 1 a hand operating device is shown with its two constituent parts, the operating handle and the hand operated reducing device connected to the side plate.

As can be seen in FIG. 1, the flanges (14) of the profiles (13) of the headers of the box (3) receive in a sliding way the set made up by the side plates (5) onto which the hand operating device (50) can assembled with screws. This operation device set is moved by the rotation of a transmission rod (51) driven by maneuver handle (52) through a couple of conventional bevel gears with a 1/1 ratio lodged in the handle box (53).

Figure 2:
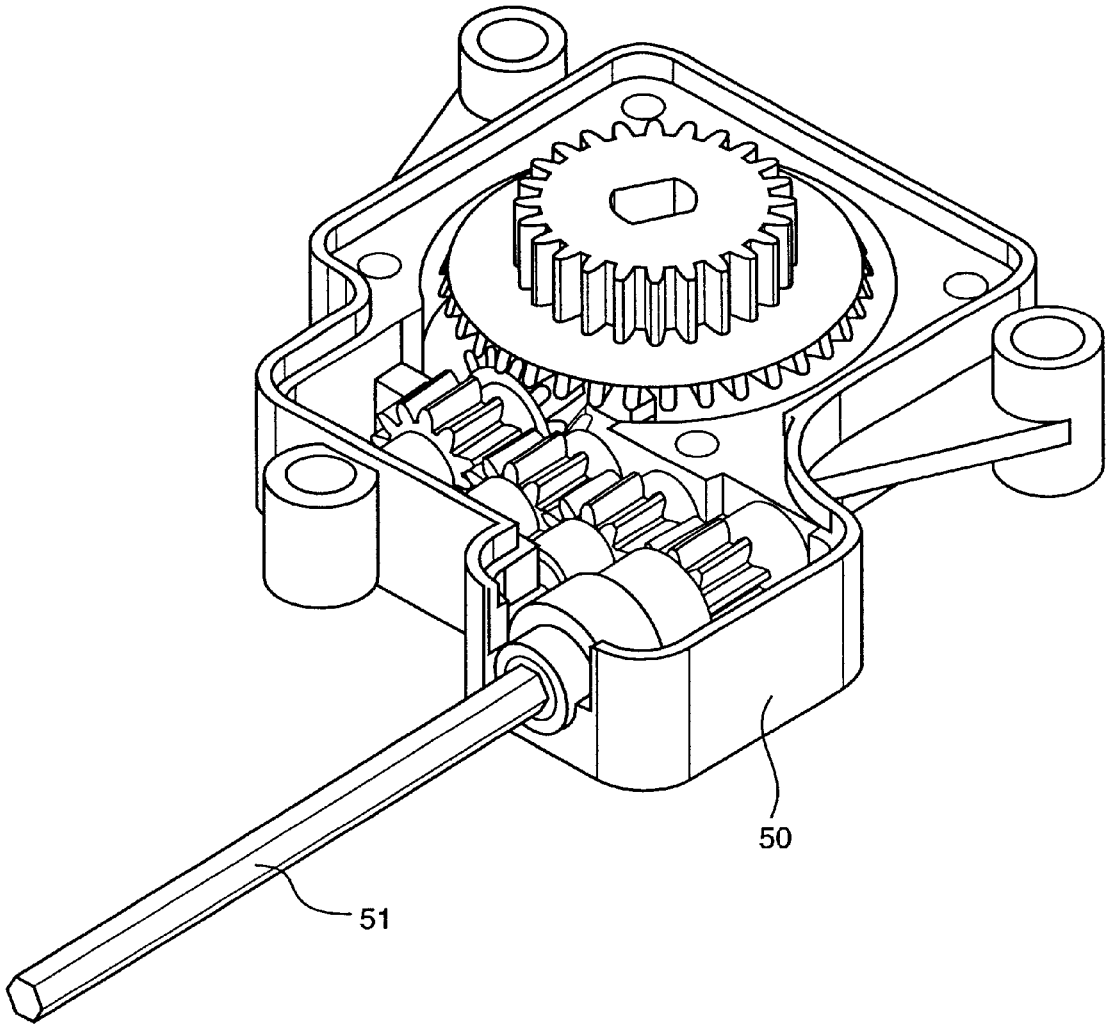
In FIG. 2 the hand operated reducing device is shown assembled in its box.
Figure 3:
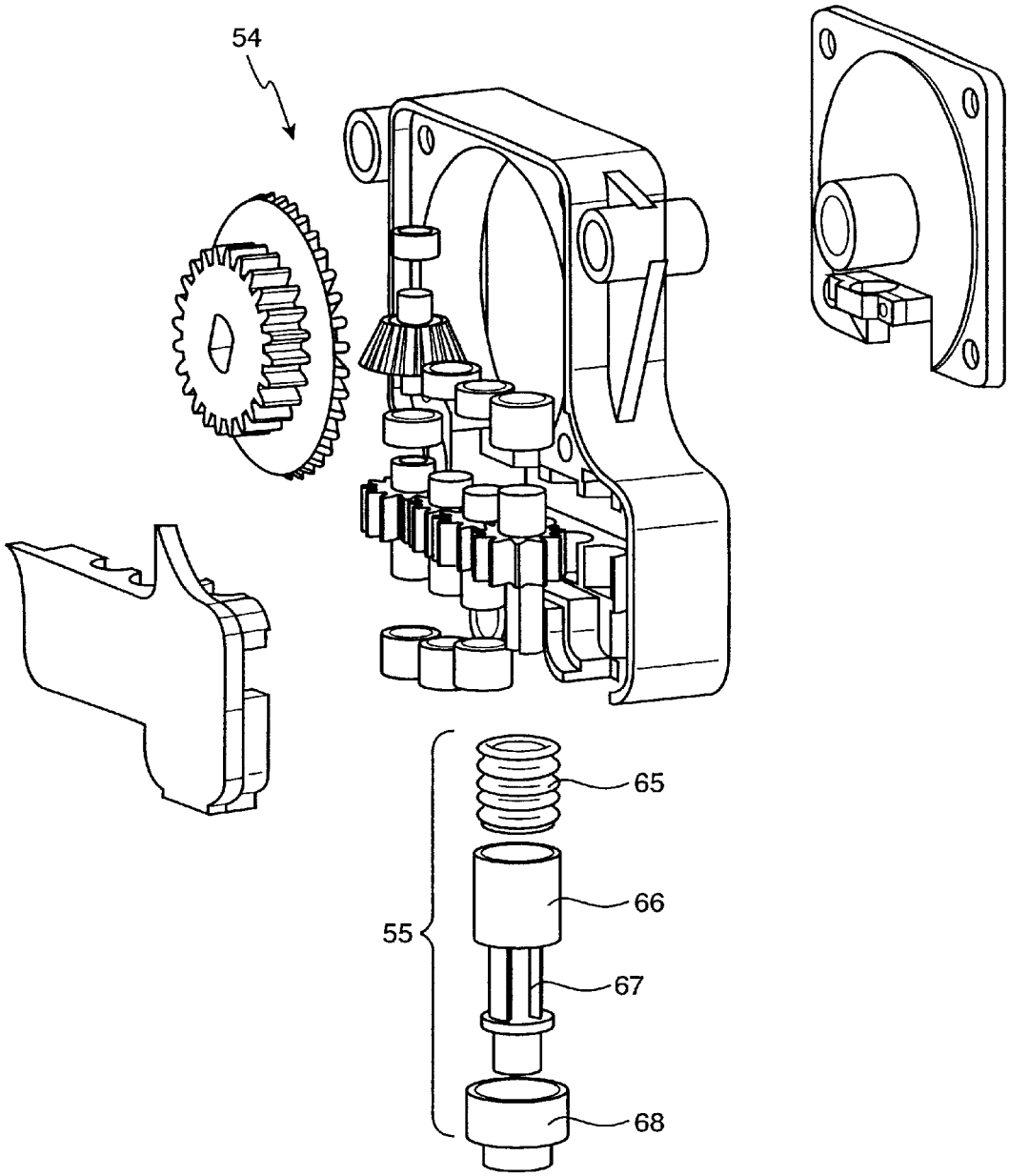
In FIG. 3 the hand operated reducing device is shown in an exploded view.
Figure 4:
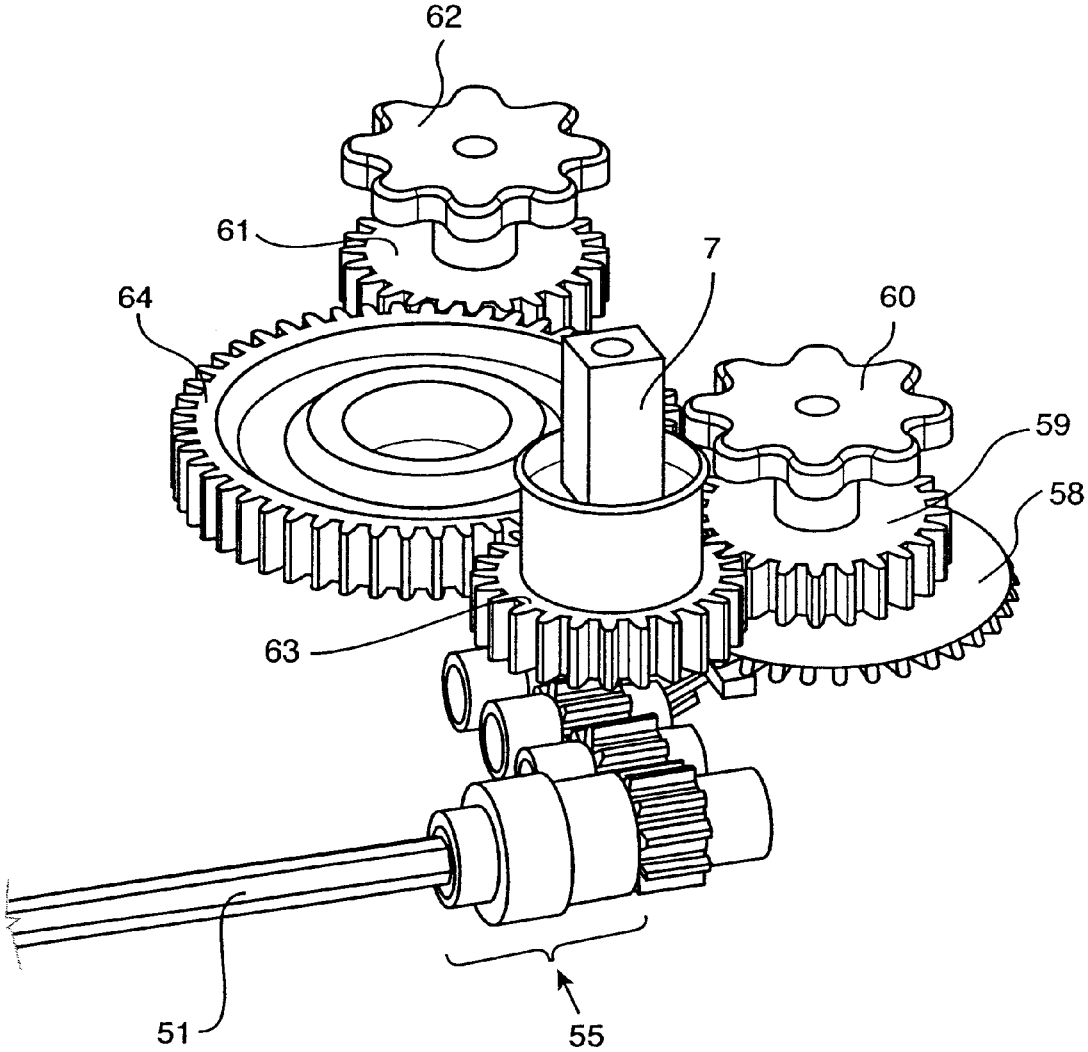
In FIG. 4 a perspective view of the transmission elements of the hand operated reducing device is shown.
Figure 5:
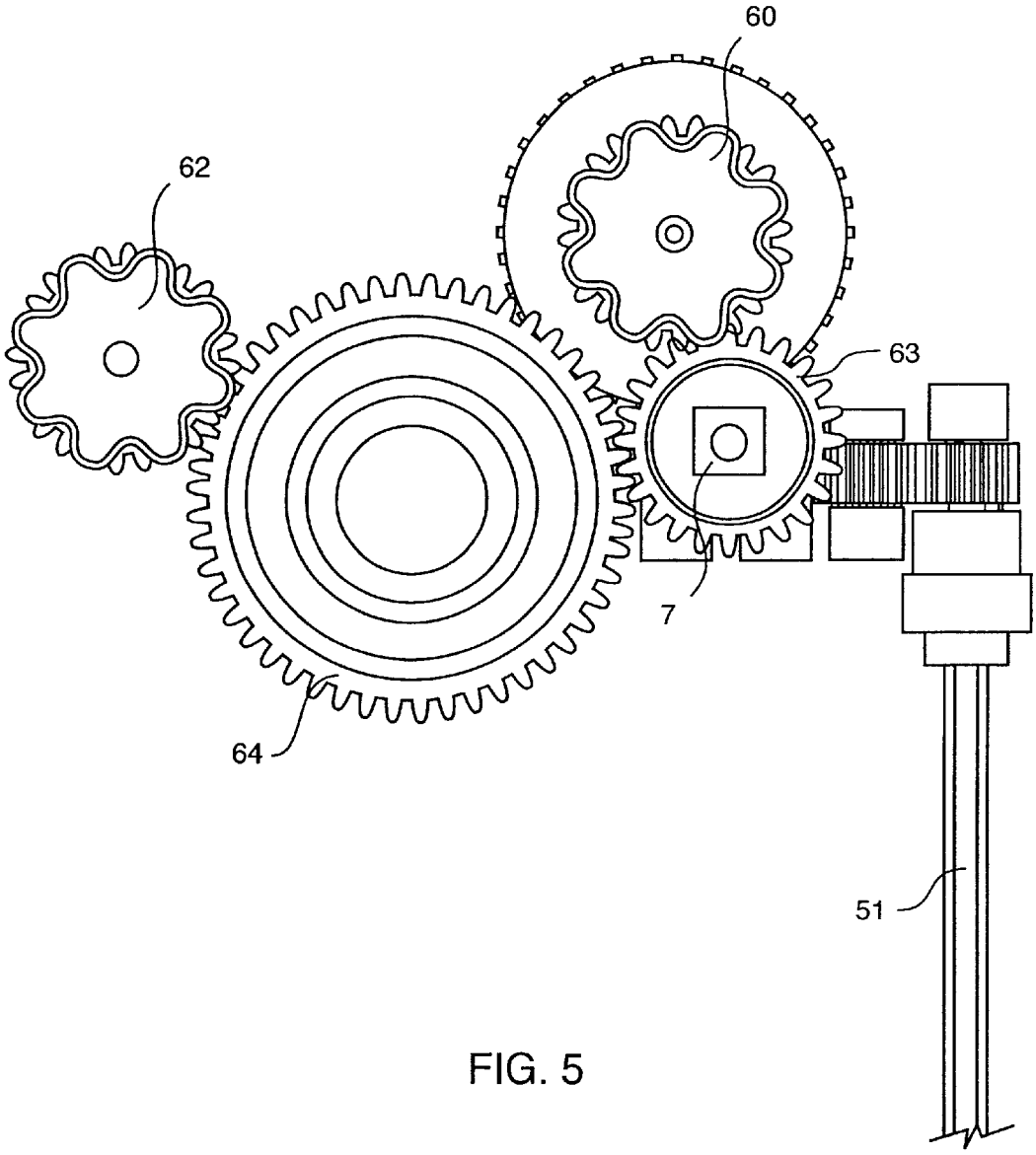
In FIG. 5 a side view of the transmission elements of the hand operated reducing device is shown.
Figure 6:
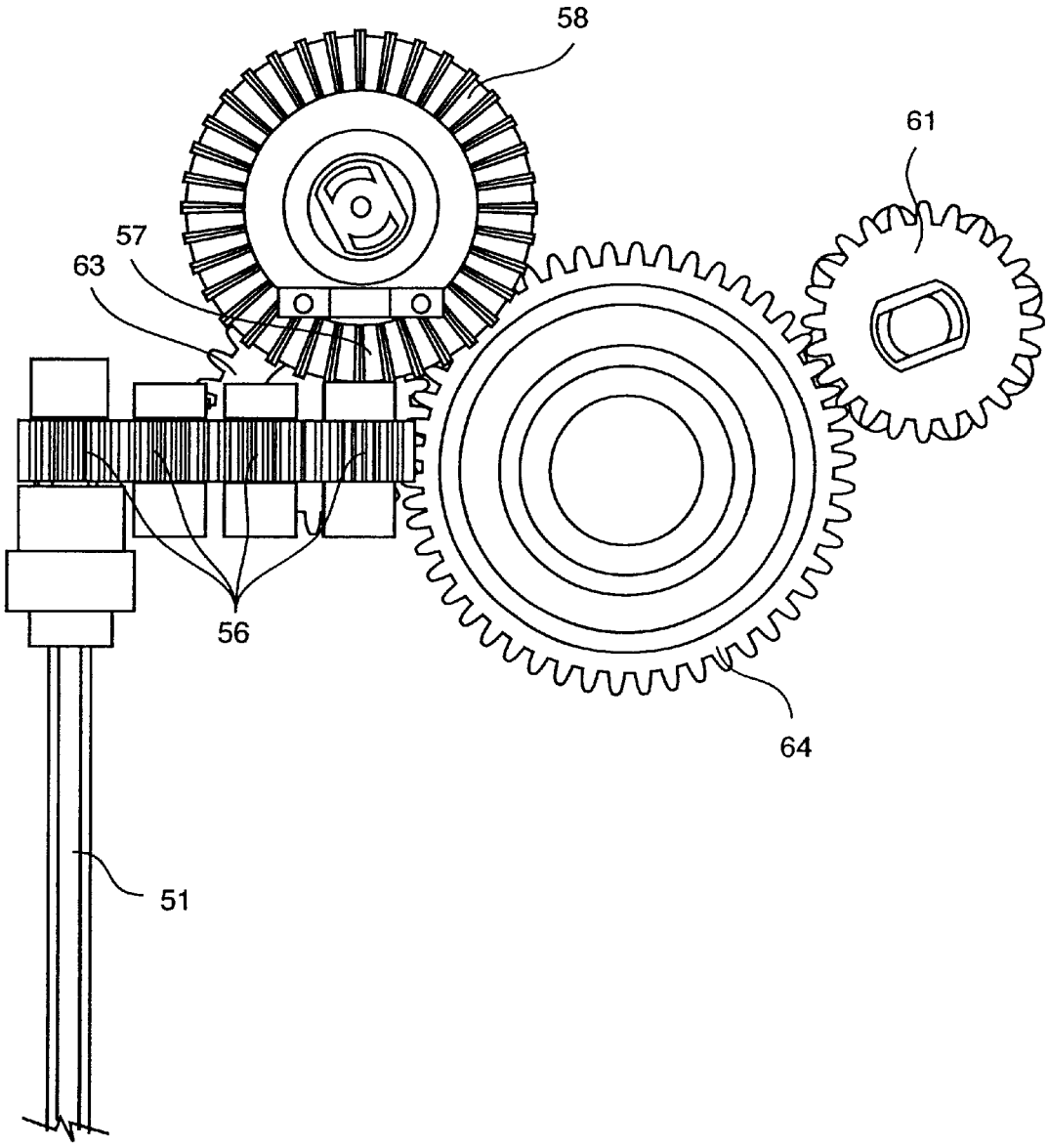
In FIG. 6 a facing side view of the transmission elements represented in FIG. 5 is shown.
Figure 7:
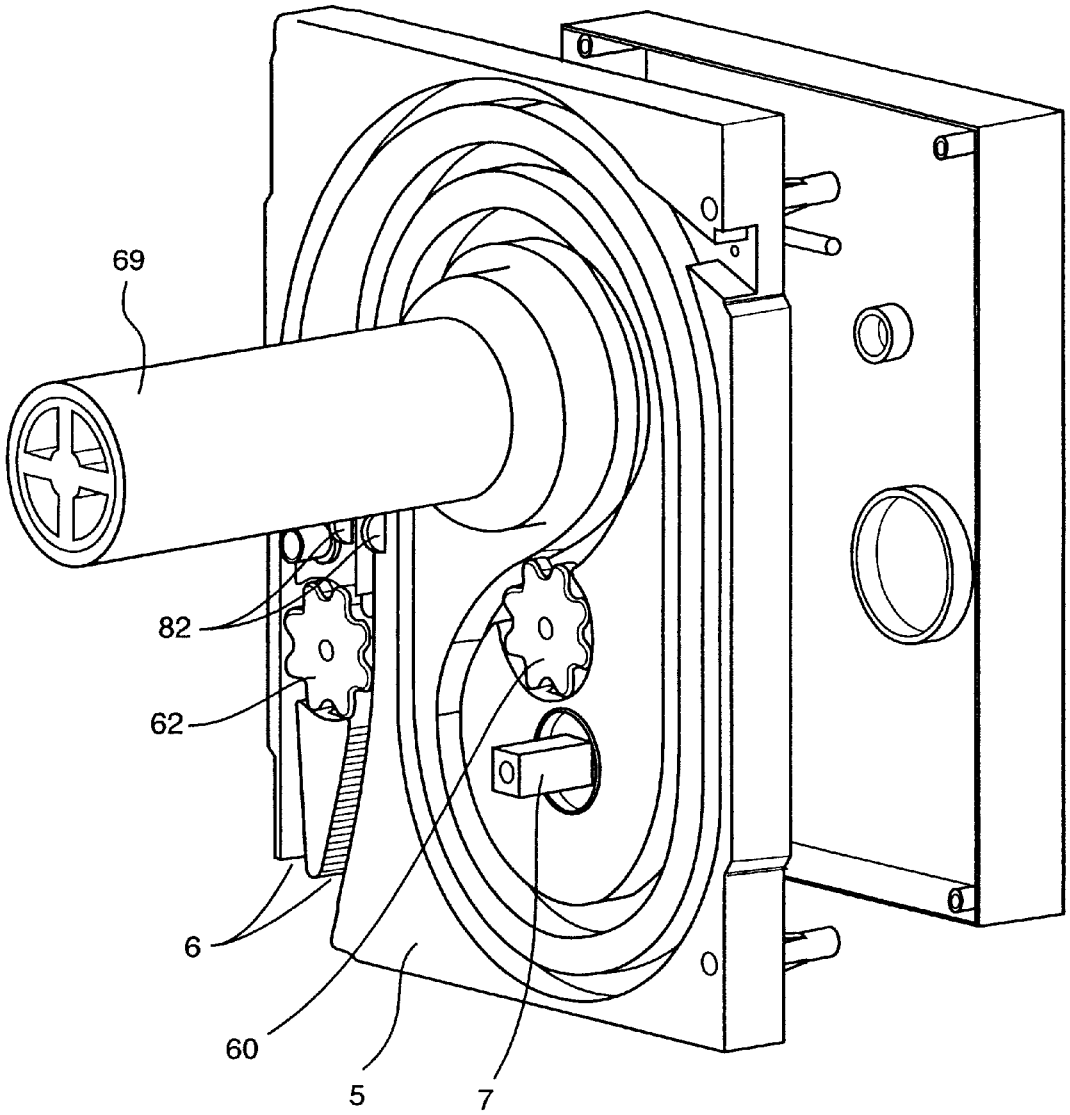
In FIG. 7 a perspective view from the middle of the window of the motorized operating device set is shown.
Figure 8:
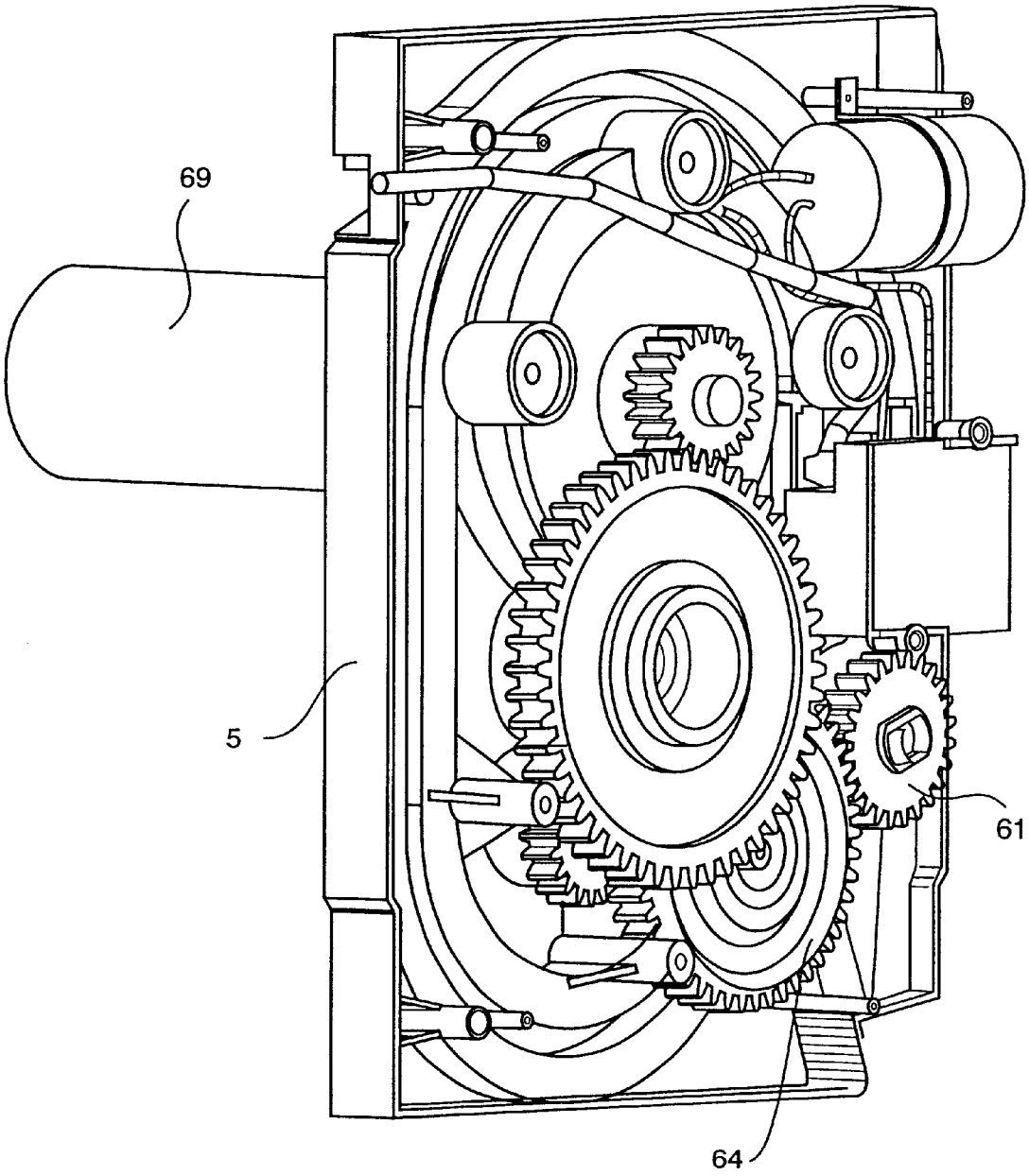
In FIG. 8 a perspective view from the side of the motorized operating set is shown.
Figure 9:
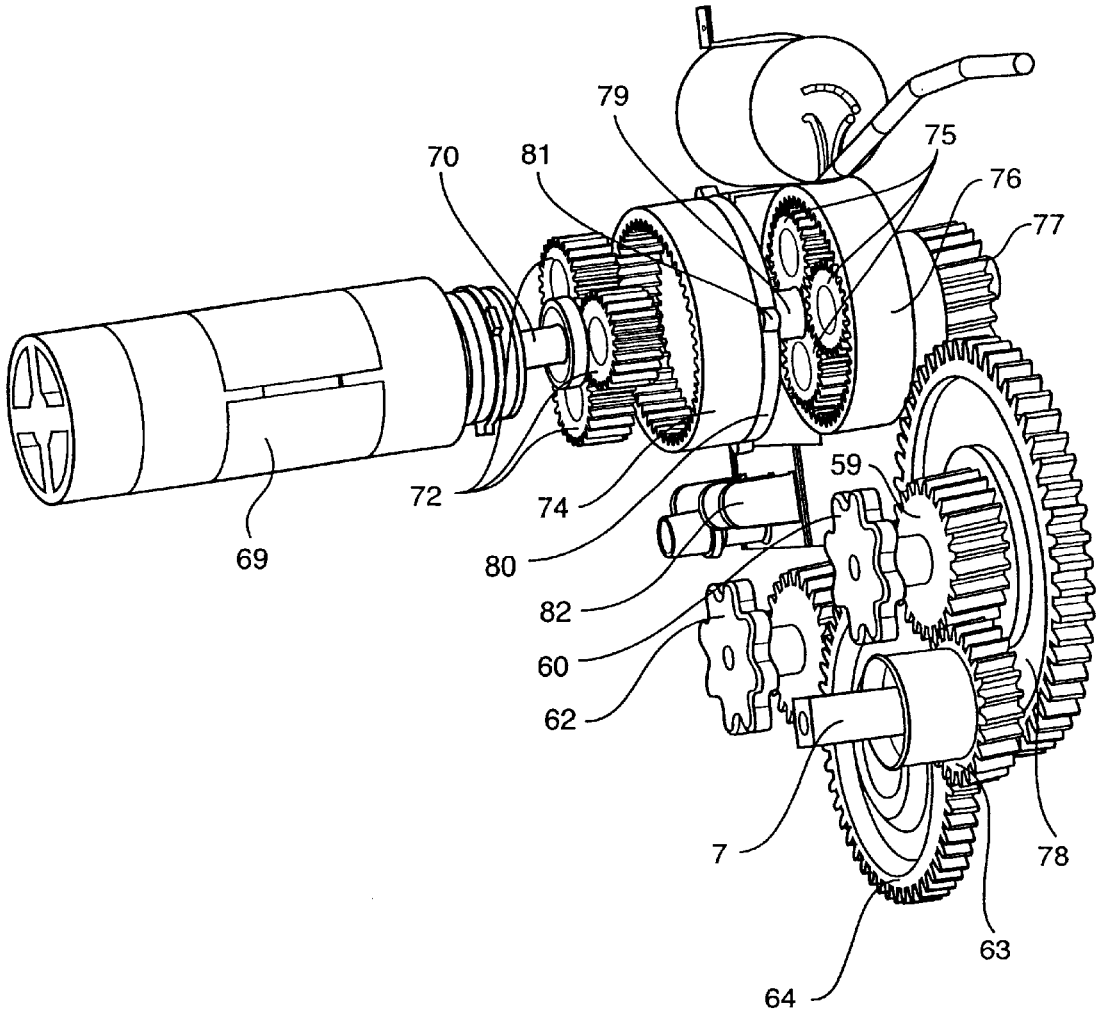
In FIG. 9 a perspective exploded view from the side of the motorized operating set is shown.
Figure 10:
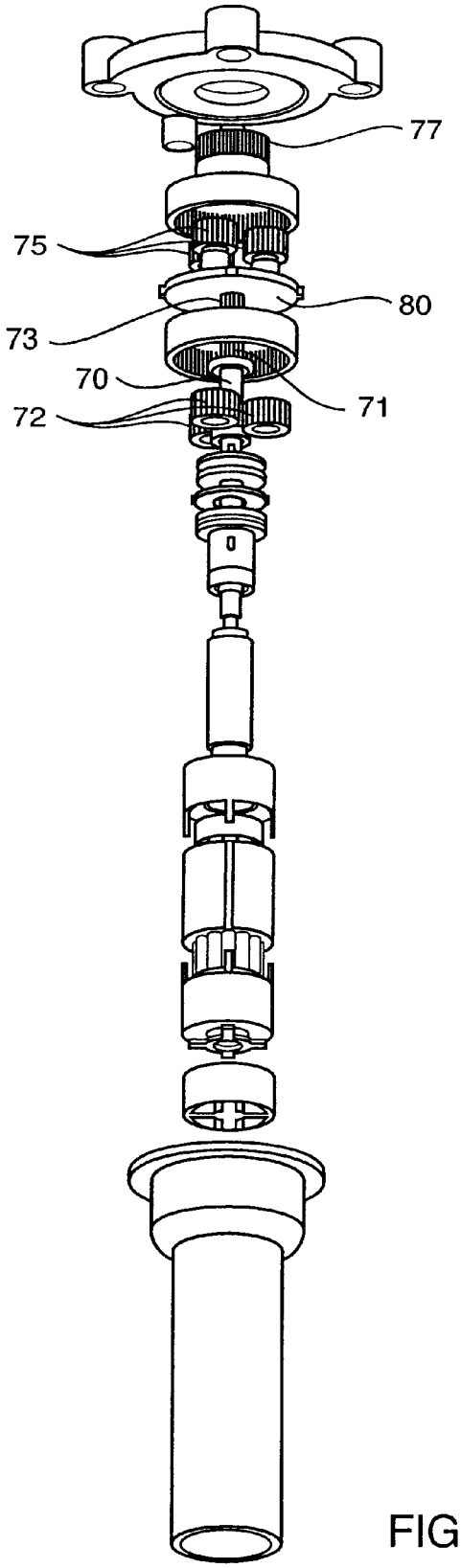
In FIG. 10 an exploded view of the planetary moto-reducing device set is shown.

In FIGS. 2 and 3 the hand operation device (50) assembled in its box and exploded may be seen to be constituted by a reducing hand operating device (54) and a bi-directional brake (55).

In FIGS. 3, 4, 5 and 6 the hand operating device (54) can be seen to be made up of a four separating pinion train (56) with coplanar parallel axis, whose only function is to separate the transmission rod (51) sideways in respect to the center of the hand operating device set, since the number of teeth of the mentioned separating pinions is 10 for the middle ones and 12 for the two external ones, so that there is no reduction in the turning velocities. This reduction is carried out basically through a bevel pinion (57) with 12 teeth, integral with the last separating pinion, and the corresponding bevel wheel (58) of 26 teeth, integral to this wheel (58) there is a first transmission pinion (59) onto which a first driving pinion (60), of the slats which make up the blind, is assembled in an axially detachable manner but turning as a whole.

The first transmission pinion (59) must transmit the movement to a second transmission pinion (61) onto which a second driving pinion (62) of the slats which make up the blind is assembled in an axially fixed but turning as a whole manner. This movement transmission between the the transmission pinion (59) and the second transmission pinion (61) is carried out thanks to a first intermediate wheel (63) integral of the axis between plates (7) onto which a second intermediate wheel (64) meshes.

The bi-directional brake (55) is of the conventional type and is made up of the set of brake springs (65), the C shaped hollow shaft (67), the brake cylinder (66) and the brake connection (68). See FIG. 3.

In FIGS. 7, 8, 9, and 10 the motorized operating device has been represented, which is made up of an alternate current asynchronous motor (69) whose shaft (70) ends in a outgoing pinion (71). This outgoing pinion goes into planetary gears of the first stage (72), while planetary wheel pinion (73) integral of the planetary wheel of the first stage (74) goes in between the planetary gears of the second stage (75), and at the same time the planetary wheel of the second stage (76) is integral to a planetary wheel pinion (77) which meshes into a motorization gear (78) which turns in a coaxial and integral manner with the first transmission pinion (59) and the driving pinion (60). The planetary gears of the second stage are assembled onto the axis (79) of a planetary gear cage (80) whose turning is prevented by the fixation of the perimetral flanges (81). The assembling of the planetary gears of the first stage is identical, not having the corresponding planetary gear cage been represented for greater clarity. See FIG. 9.

The ends of travel (82) are lodged in the corresponding slots (83) of the side plates (5) in order to detect the presence of the blind at each of the guides (6). See FIGS. 1, 7 and 9.

In what pertains to the slats, as can bee seen in FIGS. 11, 12, 13 and 14, the intermediate slat (101) of the invention, being hollow and rectangular in section, has at one of its ends or edges a protraction (102) laterally displaced with respect to the side in order to make up with the latter a wide step (103), being such protraction ended in an inward rounded crank in order to determine a sort of hook (104). The internal surface of the section facing that of the step (103) and the beginning of the protraction itself (102), is a curve-concave surface (109).

Figure 11:
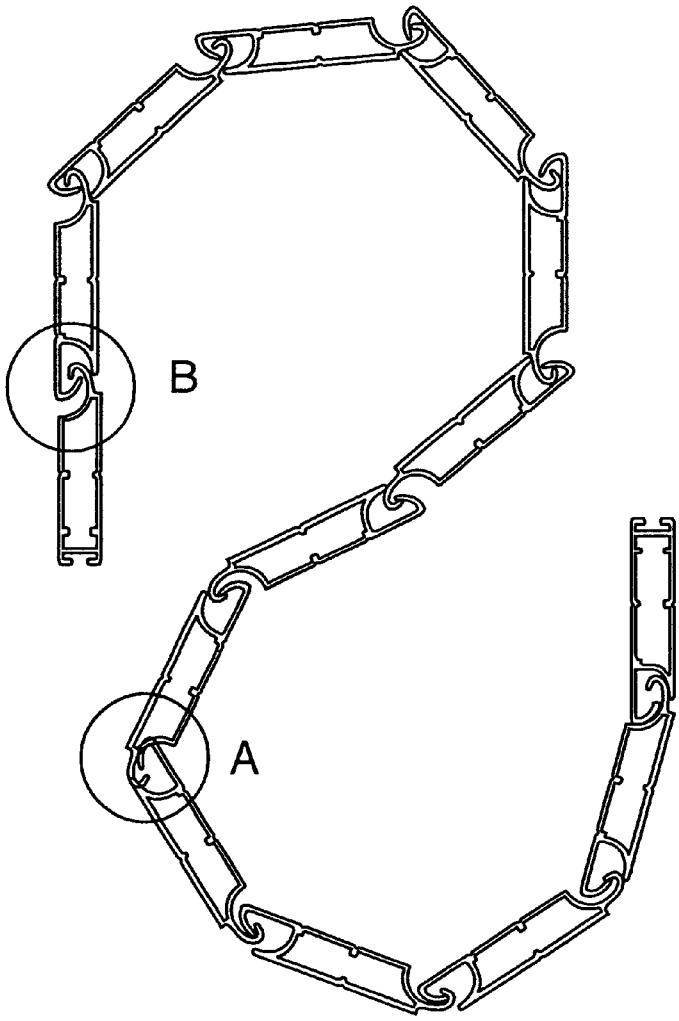
In FIG. 11, a close-up of several interconnected slats is shown, which follow direction changes which can correspond to a labyrinth track.
Figure 12:
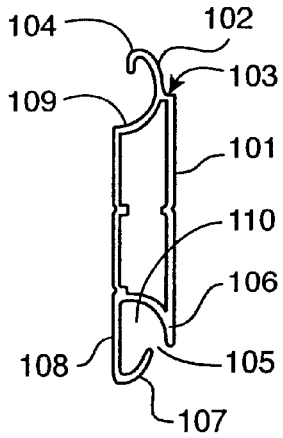
In FIG. 12, a section of the intermediate slat according to the invention is shown.

The opposing end or edges has an opening (105) determined between the edges of two flanges (106, 107), being one of the flanges straight (106), while the other flange (107) is determined by a protraction arched inward of the side (108), being the external curve of said inward cranked flange (107) complementary of the curve-concave surface (109) adapting among themselves when the closing is done, as seen in FIG. 11.

According to the characteristics of the slat described, the formation of a blind will be done by merely linking correlatively several of them, as seen in FIG. 11.

The linkage is done by introducing the hook (104) of an intermediate slat (101) through the opening (105) corresponding to the opposing edge of the adjoining one. Due to the special configuration determined by the straight flange (106), the inward cranked flange (107) and the opening (105), the hook (104) is lodged inside the corresponding intermediate slat channel (110), in such a way that when the slats tend to detach, the hook (104) links with the inward cranked flange (107) preventing that possible detachment, being the link ensured by the stopper which the free edge of the straight flange (106) supposes, against which the external part of said hook (104) or the protraction (102) of which it is a part, will stop.

When the blind is lodged in the labyrinth it acquires a curvature such that the angle between the two adjoining slats is of approximately 127°. In these conditions, the curvature of hook (104) perfectly adapts to that of the inward cranked flange (107). See close-up A of FIG. 11. By contrast, when the two adjoining slats are hanging one from the other, the dragging between the hook and the inward cranked flange (107) is done in an off-centered manner causing an overturning couple on the slat, which makes it lean on the two sides of the lateral tracks simultaneously.

Figure 13:
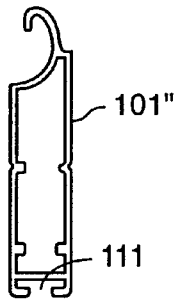
In FIG. 13, a section of the bottom end slat according to the invention is shown.
Figure 14:
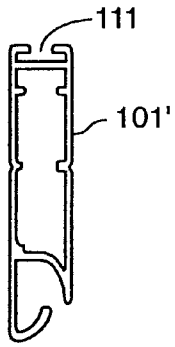
In FIG. 14, a section of the top end slat according to invention is shown.

The top slat (101') and bottom end slat (101") which will complement the blind, are furnished besides the linking channel at FIG. 14 and the hook at FIG. 13, respectively, with an extremity channel (111), with a narrowing at their entrance for lodging and retaining a joint or weather strip, as an isolating closing element at its leaning point on the top and bottom parts, depending on the portion of the blind.

The working of the operating devices is as follows. The user turns the handle (52) one way or the other which through a couple of conventional bevel pinions, not shown, which the handle box (53) incorporates, transmits the motion to the transmission rod (51) which connects in a rigid turning manner in a recess for this purpose which the brake connection (68) has.

The C shaped hollow shaft integral in turning to the mentioned brake connection (68) drives a fastening pin of the shaft of the first separation pinion (56) which inserts inside of it, at the same time it drives the omega shaped springs with legs inward which, encapsulated inside an elastic tube, make up the set of brake springs (65). The motion is transmitted, in consequence, to the train of separating pinions (56), to the bevel pinion (57), bevel wheel (58), first transmission pinion (59) and first driving pinion (60), receiving the second driving pinion (62) the turning movement through the first transmission pinion (59), first intermediate wheel (63), second intermediate wheel (64) and second transmission pinion (61). See FIG. 4.

Figure 15:
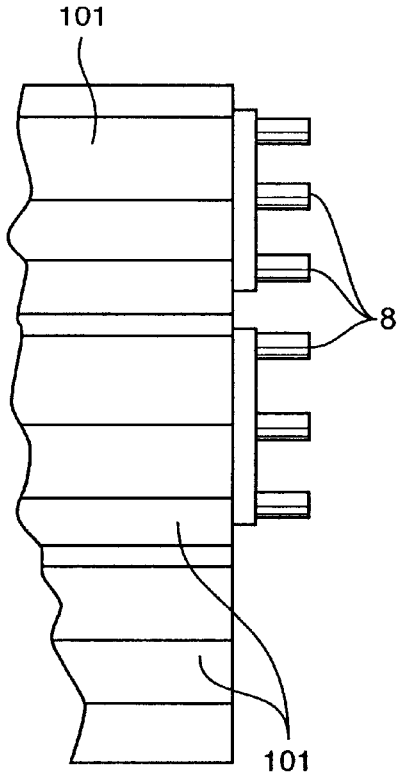
In FIG. 15, the arrangement of slats and cylindrical projections in the prior art (U.S. Pat. No. 5,722,476) is shown.
Figure 16:
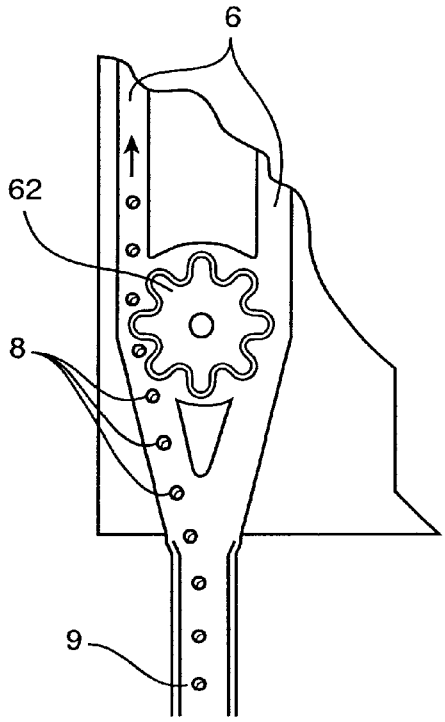
In FIG. 16, the way drive pinions and cylindrical projection mesh in the prior art (U.S. Pat. No. 5,722,476) is shown.

Finally, the driving pinions (60), (62) mesh with the cylindrical projections (8) of the slats (101) which circulate through the labyrinth guides (6) producing the motion of the blind. See FIGS. 15 and 16. Once at rest, the latter is braked because of the fastening pin which the shaft of the first separating pinion (56) has, tends to open the inward legs omega shaped springs, which constitute the set of brake springs (65) and which when expanding in diameter wedge into the inside of the brake cylinder (66) which cannot turn.

We do not describe in greater detail this bi-directional brake device (55) because it is widely used in the slat blind sector and more than enough known for any expert in the matter.

In respect to the motorized operating device, the motion is produced from the motor (69) which through the motor pinion (71), first stage planetary gears (72), first stage planetary wheel (74) and its pinion (73), planetary gears of the second stage (75), wheel of the second stage (76) and its pinion (77), transmits the rotation in both directions to the motorization gear (78) and from the latter to the first transmission pinion (59) and the first driving pinion (60) which are coaxial and integral in turn to the same. The motion of the second driving pinion (62) is caused in a similar manner to that described for manual operation through the first intermediate wheel (63), second intermediate wheel (64) and second transmission pinion (61). See FIGS. 8, 9 and 10.

Once the blind is at rest, it is braked by a conventional bi-directional brake incorporated to the motor.

What is claimed is:

1. A reversible blind, having slats which follow a curved path, the slats having at one of their edges a projection which ends in a hook for linking with an adjoining slat and having at an opposite edge a channel defined between a first flange and a second flange, the channel being adapted to link with hook of an adjoining slat, said hook having a curvature that adapts to a curvature of an inwardly disposed portion of the second flange of an adjoining slat so that adjoining slats form an angle which corresponds to a position that said adjoining slats occupy when the blind is in a region with greatest curvature of said curved path, wherein the inwardly disposed portion of the second flange, covers more than half of a width of the slat, which causes adjoining slats to lean simultaneously on the two sides of a lateral track where they are assembled.

2. A reversible blind according to claim 1, further comprising a hand operating device which drives a first transmission pinion, and a first driving pinion connected to said first transmission pinion, said first transmission pinion transmitting movement to a second transmission pinion and a second driving pinion, said second driving pinion being coaxial to and integral with the second transmission pinion, by means of a first intermediate wheel connected to the first transmission pinion and meshing into a second intermediate wheel, in such a way that movement of the blind is caused when cylindrical projections of the slats mesh into said first and second driving pinion.

3. Reversible blind, according to claim 1, comprising a motorized operating device which drives a first transmission pinion and a first driving pinion connected to the first transmission pinion, said first transmission pinion transmitting movement to a second transmission pinion and a second driving pinion, said second driving pinion being coaxial to and integral with the second transmission pinion, by means of a first intermediate wheel connected to the first transmission pinion and meshing into a second intermediate wheel, in such a way that movement of the blind is caused when cylindrical projections of the slats mesh into said first and second driving pinion.

4. The reversible blind according to claim 3, wherein the motor operating device comprises:

a motor which transmits motion to a motor pinion;

first stage planetary gears associated with the motor;

a first stage wheel and an first stage wheel pinion;

second stage planetary gears associated with the motor;

a second stage wheel and a second stage wheel pinion; and a motorization gear integral with the first transmission pinion.

5. A reversible blind comprising a plurality of slats to be guided by a lateral track, said slats comprising:

a first edge and a second edge, the second edge being located opposite of the first edge;

a projection disposed on the first edge of the slats, the projection having a hook defining a curvature and for linking with an adjoining slat; and a first flange and a second flange disposed on the second edge of the slats, the first flange and the second flange together defining a channel in which the hook of an adjoining slat is inserted, wherein the second flange defines an inwardly disposed portion extending across more than half of the width of the slat and having a curvature, such that the interrelationship between the hook of one slat and the second flange of the adjoining slat causes said slats to lean on both sides of the lateral track during movement.

6. The reversible blind of claim 5, further comprising a hand operating device, said hand operating device including:

a pinion train comprising a plurality of pinions having coplanar and parallel axes and having an extremity pinion;

a bevel pinion integral with the extremity pinion of said pinion train;

a bevel wheel meshing with said bevel pinion; and a transmission pinion integral with said bevel wheel, wherein the bevel wheel transmits motion to the transmission pinion.

7. The reversible blind of claim 5, further including a motor operating device and a transmission pinion, the motor operating device comprising:

a motor;

a motor pinion to which motion transmitted;

first stage planetary gears connected to the motor pinion;

a first stage wheel associated with the motor;

a first stage wheel pinion integral with the first stage wheel;

second stage planetary gears connected to the first stage wheel pinion;

a second stage wheel associated with the motor;

a second stage wheel pinion integral with the second stage wheel; and a motorization gear integral with the transmission pinion.

8. A reversible blind having slats which follow a curved path, the slats having at one of their edges a projection which ends in a hook for linking with an adjoining slat and having at an opposite edge a channel defined between a first flange and a second flange, the channel being adapted to link with the hook of an adjoining slat, the hook having a curvature that adapts to a curvature of an inwardly disposed portion of the second flange of an adjoining slat so that adjoining slats form an angle which corresponds to a position that they occupy when the blind sits in a region with greatest curvature of said curved path, wherein the inwardly disposed portion of the second flange covers more than half of a width of the slat, which results in a connection between adjoining slats causing each slat to lean simultaneously on the two sides of a lateral track where they are assembled, the blind further comprising a hand operating device which drives a first transmission pinion and a first driving pinion connected to the first transmission pinion, said first transmission pinion transmitting the movement to a second transmission pinion and a second driving pinion, said driving pinion being coaxial to and integral with the second transmission pinion, by means of a first intermediate wheel connected to the first transmission pinion and meshing into a second intermediate wheel, in such a way that the movement of the blind is caused when cylindrical projections of the slats mesh into the first and second driving pinion, wherein the hand operating device comprises a separating pinion train including a plurality of pinions having coplanar and parallel axes and a bevel pinion integral with an extremity pinion of the pinion train, the hand operating device further comprising a bevel wheel to transmit motion to the first transmission pinion, the transmission pinion being integral with the bevel wheel.

* * * * *